United States Patent [19]

Knowles et al.

[11] Patent Number: 4,522,191

[45] Date of Patent: Jun. 11, 1985

[54] NON-PULL APART TELESCOPING ROOF JACK ASSEMBLY FOR FURNACE

[75] Inventors: Joe E. Knowles; Mellie E. Winters, both of Wichita, Kans.

[73] Assignee: The Coleman Company, Inc., Wichita, Kans.

[21] Appl. No.: 569,918

[22] Filed: Jan. 11, 1984

[51] Int. Cl.[3] ..... F23J 11/00

[52] U.S. Cl. ..... 126/307 R; 98/60; 126/318

[58] Field of Search ..... 126/307 R, 312, 307 A, 126/313–319, 120, 121; 98/60, 48, 58; 138/111–114, 120, 148, 150; 285/302, 133 R

[56] References Cited

U.S. PATENT DOCUMENTS

| | | | |
|---|---|---|---|
| 503,818 | 8/1893 | Watt | 126/314 |
| 724,210 | 3/1903 | Scherer | 285/302 |
| 1,060,328 | 4/1913 | Farley et al. | 126/314 |
| 2,679,867 | 6/1954 | Epstein | 285/133 R |
| 2,898,839 | 8/1959 | McKann | 126/307 R |
| 2,976,797 | 3/1961 | Newbill | 126/307 R |
| 3,094,980 | 6/1963 | Inabnit | 126/121 |
| 3,171,402 | 2/1965 | Carlson | 126/307 R |
| 3,308,808 | 3/1967 | Malafouris | 126/307 R |

FOREIGN PATENT DOCUMENTS

| | | | |
|---|---|---|---|
| 2925255 | 1/1981 | Fed. Rep. of Germany | 126/307 R |

*Primary Examiner*—James C. Yeung

[57] ABSTRACT

A telescoping roof jack assembly for a furnace includes a pair of outer telescoping tubes and a pair of inner telescoping tubes. At least one of the pairs of tubes is provided with cooperating detents which prevent the telescoping tubes from separating. A plurality of connectors are attached to one of the inner tubes and extend slidably through openings in one of the outer tubes. The connectors cause the inner and outer tubes to telescope together while permitting relative transverse movement between the inner and outer tubes.

6 Claims, 9 Drawing Figures

9 9

NON-PULL APART TELESCOPING ROOF JACK ASSEMBLY FOR FURNACE

BACKGROUND

This invention relates to a roof jack assembly for a furnace, and, more particularly, to a telescoping roof jack assembly which cannot be pulled apart.

Sealed combustion forced air furnaces conventionally use of roof jack assembly for supplying combustion air and for exhausting flue gases. The roof jack assembly extends upwardly from the furnace through the roof of the dwelling and includes an inner tube for exhausting flue gases and an outer tube for supplying outside air for combustion.

Sealed combustion furnaces are commonly used in mobile homes or manufactured housing. Mobile homes are usually provided with a very tight, sealed construction, and all of the air for combustion in the furnace must be obtained from outside the home.

Conventional roof jacks consist of two concentric tubes. The inner tube provides a passage for flue gases to the outside, and the outer tube provides a path for combustion air from the outside to the furnace burner. The upper ends of the inner and outer tubes terminate above the roof line of the home and are protected by rain caps.

Manufactured homes are built with wide variations of roof heights and variations in attic depts and ceiling heights above the furnace. Accordingly, roof jacks must either have a telescoping feature, or the tubes must be long enough to accommodate the widest variation and then be cut to length at the time of installation. The disadvantage with the latter procedure is that this is basically a cut-and-try installation for each particular home, and proper fit is totally dependent on the care and expertise of the installer.

The telescoping feature allows flexibility in the installation. However, even with a telescoping jack, the wide variations in roof heights and attic cavity depths require the availability of several different lengths of telescoping roof jacks. When too short a telescoping assembly is used, the telescoping tubes can be pulled apart. Further, the outer and inner tubes generally telescope independently of each other, which raises the possibility that one or the other of the tubes might not be securely attached to the furnace.

SUMMARY OF THE INVENTION

The invention utilizes the telescoping concept but incorporates significant safety and installation advantages. The telescoping outer tube is provided with a circumferential bead at its upper end, and the mating stationary outer tube is provided with a corresponding circumferential bead at its lower end. The beads interfere with each other and provide a stop or detent which prevents separation of the outer tubes.

The inner telescoping tube is attached to the outer telescoping tube at the lower ends thereof by metal straps. One end of each strap is secured to the inner pipe, and each strap extends slidably through a slot in the outer tube. The straps ensure that the inner and outer tubes telescope together, and the sliding connections between the straps and the outer tube permit the inner tube to move transversely relative to the outer tube to accommodate variations in the concentricity of the air inlet and flue outlet tubes on the furnace.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
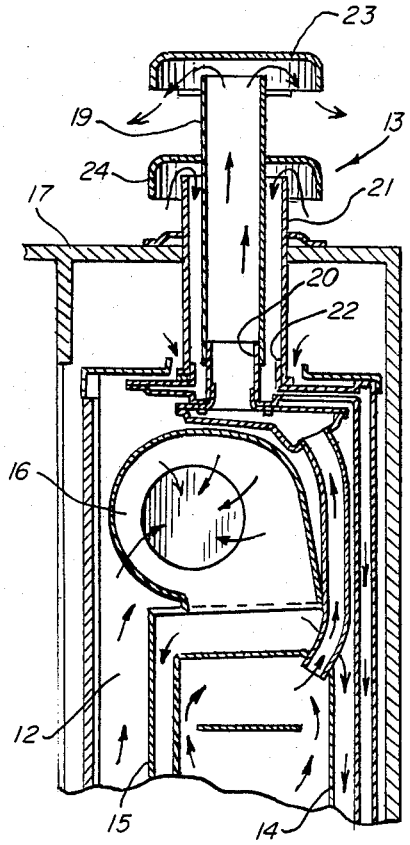
FIG. 1 PRIOR ART
FIG. 1 is a fragmentary sectional view of a prior art sealed combustion forced air furnace and roof jack assembly.

FIG. 1 illustrates a prior art sealed combustion forced air furnace 12 and roof jack assembly 13. The details of the furnace and roof jack assembly are described in U.S. Pat. Nos. 3,614,949, 3,656,470, and 3,685,577.

The furnace 12 includes a combustion chamber 14, a heat exchanger chamber 15, and a centrifugal air blower 16. The air blower draws room air into the heat exchanger and forces it past the combustion chamber and through hot air ducts back to the rooms.

The roof jack assembly 13 extends through the ceiling 17 of the mobile home or other dwelling and provides outside combustion air to the combustion chamber and conveys products of combustion and flue gases to the outside. The roof jack assembly includes an inner flue tube 19 which connects to a flue outlet pipe 20 of the furnace and an outer air inlet tube 21 which connects to an air inlet pipe 22 to the furnace. The upper ends of the flue tube and air inlet tube are protected by rain caps 23 and 24, respectively.

The operation of the roof jack assembly 13 and the furnace 12 is well known to those skilled in the art and is explained in detail in the aforementioned United States patents.

Figure 2:
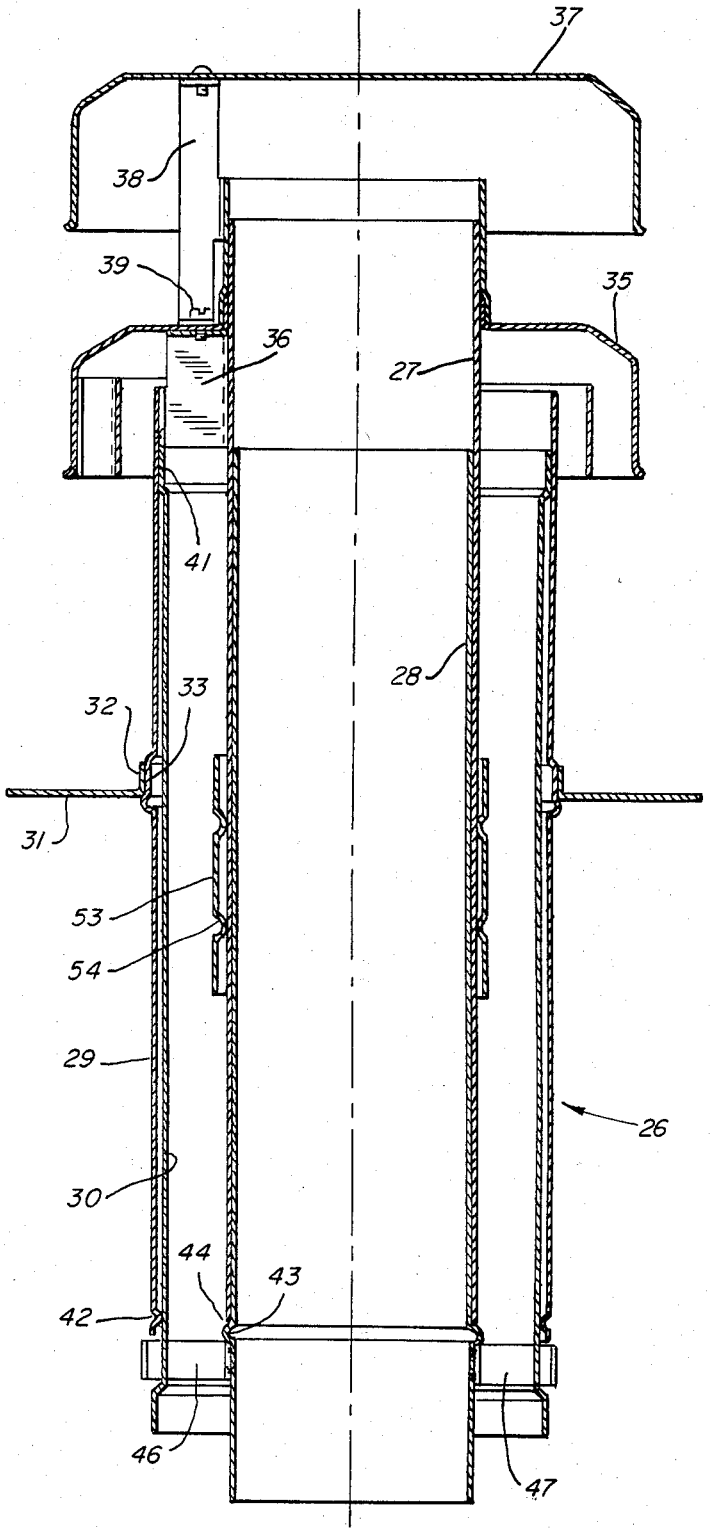
FIG. 2 is a sectional view of a roof jack assembly formed in accordance with the invention.

FIG. 2 illustrates a roof jack assembly 26 formed in accordance with the invention. The roof jack assembly 26 includes a pair of inner telescoping tubes 27 and 28 and a pair of outer telescoping tubes 29 and 30. The outer tube 29 is fixed to the roof of the dwelling by a roof mounting plate 31. The mounting plate includes an upwardly extending flange 32 which is welded to a radially outwardly extending head 33 on the outer tube 29. The outer tube is therefore stationary with respect to the roof, and the other outer tube 30 telescopes within the stationary tube 29.

Figure 9:
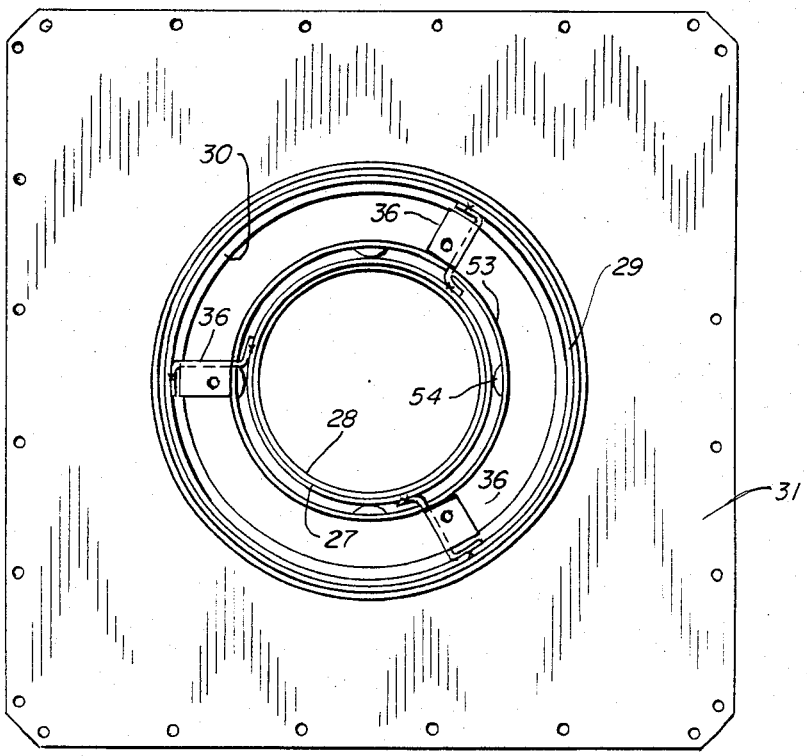
FIG. 9 is a top plan view taken along the line 9—9 of FIG. 8.
Figure 8:
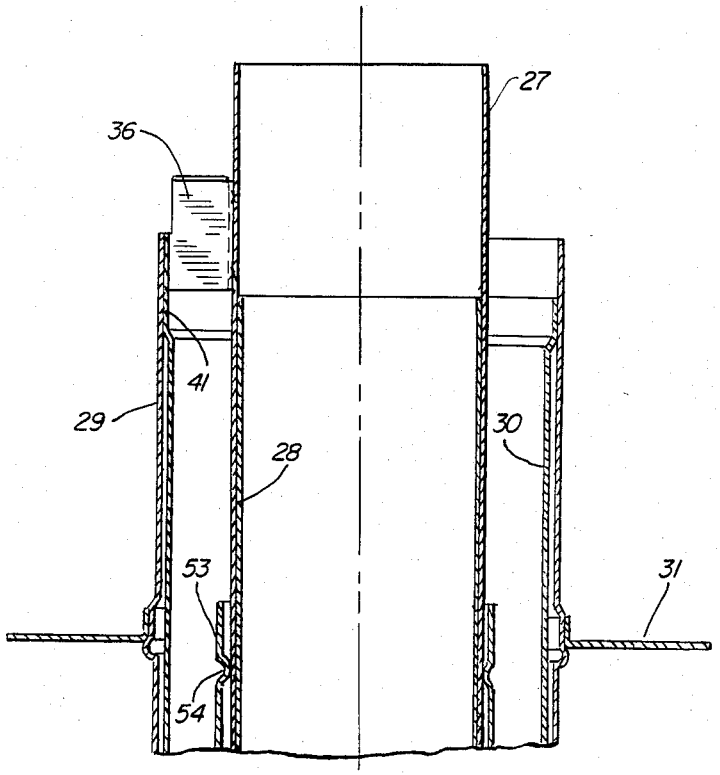
FIG. 8 is a fragmentary sectional view of the upper portion of the roof jack assembly without the rain caps.

The inner tube 27 is also stationary with respect to the roof. A rain cap 35 is mounted above the stationary outer tube 29 by three circumferentially spaced brackets 36 which are spot-welded to the stationary outer tube 29 and to the stationary inner tube 27 (see also FIGS. 8 and 9). A rain cap 37 is mounted above the stationary inner tube 27 by three brackets 38 which are attached to the rain cap 35 and the brackets 36 by screws 39.

Figure 3:
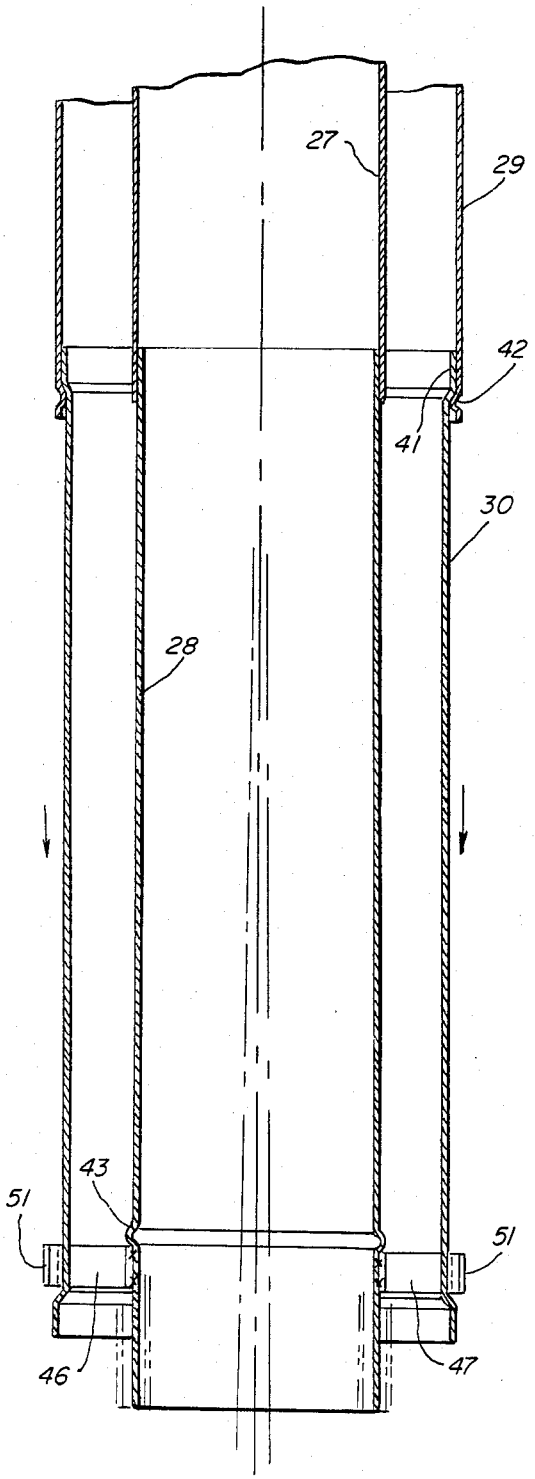
FIG. 3 is a fragmentary sectional view showing the roof jack assembly in a fully extended position.
Figure 4:
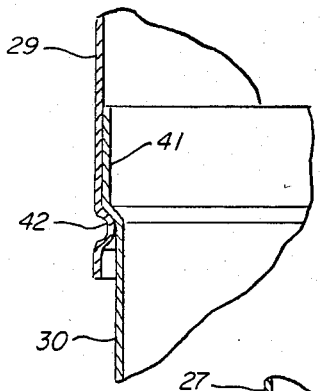
FIG. 4 is an enlarged fragmentary sectional view of the interfering beads on the outer tubes.

The upper end of the telescoping outer tube 30 is provided with a radially outwardly extending head 41 which is engageable with a radially inwardly extending bead 42 formed at the lower end of the stationary outer tube 29 (see also FIGS. 3 and 4). The beads 41 and 42 provide a stop or detent which prevents the outer tubes from being completely pulled apart, i.e., prevents the telescoping outer tube 30 from being withdrawn completely from the stationary outer tube 29. FIGS. 3 and 4 illustrate the outer tubes in their fully extended position in which the interfering beads 41 and 42 bear against each other to prevent further telescoping movement.

Figure 5:
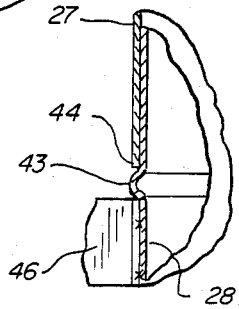
FIG. 5 is an enlarged fragmentary sectional view of the interfering bead on the lower inner tube.

The inner tube 28 telescopes within the stationary inner tube 27 and is provided with a radially outwardly extending bead 43 adjacent its lower end which is engageable with the lower end 44 of the stationary inner tube 27 (see also FIG. 5). The bead 43 provides a detent or stop which prevents the telescoping inner tube 28 from being pushed too far upwardly into the stationary inner tube 27.

Figure 6:
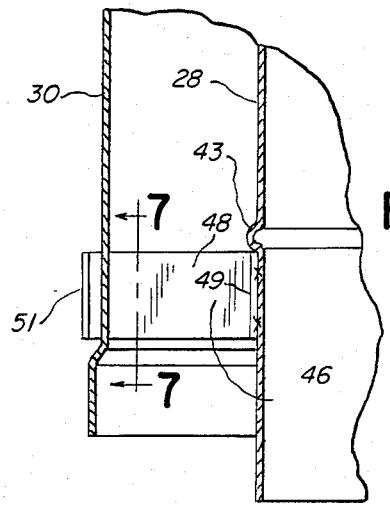
FIG. 6 is an enlarged fragmentary sectional view of the connecting straps.
Figure 7:
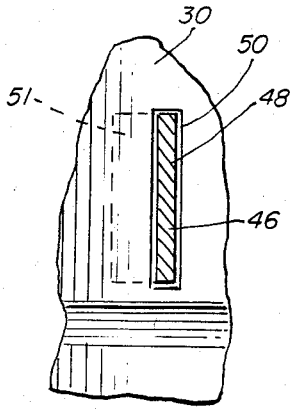
FIG. 7 is a fragmentary sectional view taken along the line 7—7 of FIG. 6.

The telescoping inner tube 28 and the telescoping outer tube 30 are connected together so that they telescope simultaneously by two diametrically opposed connecting straps 46 and 47 (FIGS. 6 and 7). Each of the connecting straps includes a flat central portion 48 and in the inner attaching flange 49 which extends generally perpendicularly to the plane of the flat central portion 48. The attaching flange 39 is spotwelded to the telescoping inner tube 28, and the flat central portion 48 extends radially outwardly therefrom in a plane which extends through the axis of the tubes. Each connecting strap extends slidably through a slot 50 (FIG. 7) in the telescoping outer tube 30 and terminates in a retaining end portion 51 which extends perpendicularly to the plane of the central portion 48. The end portions 51 prevent the straps from moving inwardly through the slots.

The portions of the connecting straps 46 and 47 which extend outwardly beyond the telescoping outer tube 30 provide gripping means which the installer can grasp for telescoping the tubes 28 and 30 with respect to the stationary tubes 27 and 29 and for guiding the lower ends of the telescoping tubes 28 and 30 into engagement with the conventional flue outlet collar and combustion air inlet collar on the furnace (see 20 and 22 in FIG. 1).

The sliding connections between the connecting straps 46 and 27 and the telescoping outer tube 30 permit the telescoping inner tube 28 to move transversely relative to the axis of the outer tube 30 as indicated in dotted outline in FIG. 3. This enables the roof jack assembly to accommodate variances in concentricity of the flue outlet collar and combustion air inlet collar on the furnace. The telescoping inner tube 28 can be moved transversely relative to the telescoping outer tube 30 by pushing or pulling on the connecting straps 46 and 47, which slide freely within the slots 50 in the outer tube 30.

In the embodiment illustrated an insulating baffle 53 surrounds the stationary inner tube 27 adjacent the roof line. The cylindrical baffle 52 is spaced from the tube 27 by circumferentially and radially spaced inwardly extending dimples 54 which are spotwelded to the tube 27. The baffle 52 serves to insulate the roof from the hot flue gases which flow upwardly through the flue tubes 27 and 28.

The telescoping flue tube 28 slides snugly within the stationary flue tube 27, and the flue tubes 27 and 28 provide a sealed path for flue gases which flow upwardly through the tubes 27 and 28 and through the space between the rain cap 37 and the upper end of the tube 27.

The bead 41 on the upper end of the telescoping air inlet tube 30 slides snugly within the stationary air inlet tube 29, and the tubes 29 and 30 provide a sealed flow path for outside combustion air which flows through the space between the rain cap 35 and the upper end of the stationary tube 29.

The telescoping tubes 28 and 30 are pulled downwardly from the stationary tubes 27 and 29 in order to accommodate the spacing between the ceiling of the dwelling and the flue outlet and combustion air inlet collars of the furnace. The interference between the beads 41 and 42 on the air inlet tubes 30 and 29, respectively, prevent incomplete withdrawal of the telescoping tubes from the stationary tubes. The telescoping tubes are prevented from being pushed too far upwardly into the stationary tubes by the bead 43 on the telescoping flue tube 28, which is engageable with the lower end 44 of the stationary flue tube 27. An upper stop can also be provided by engagement between the connecting straps 46 and 47 and the lower end of the stationary air inlet tube 29.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A roof jack assembly for a furnace comprising a first pair of outer telescoping tubes, a second pair of inner telescoping tubes positioned generally concentrically within the outer tubes, connecting means extending between one of the outer tubes and one of the inner tubes for causing the tubes to move together in an axial direction while permitting relative transverse movement between the tubes and means on at least one of said pairs of telescoping tubes for preventing the tubes of said one pair from being separated said connecting means comprising at least one connecting member extending generally radially between one of the outer tubes and one of the inner tubes and extending slidably through an opening in one of said tubes.

2. The assembly of claim 1 in which said connecting member is secured to the other of said tubes.

3. A roof jack assembly for a furnace comprising a first pair of outer telescoping tubes, a second pair of inner telescoping tubes positioned generally concentrically within the outer tubes, connecting means extending between one of the outer tubes and one of the inner tubes for causing the tubes to move together in an axial direction while permitting relative transverse movement between the tubes and means on at least one of said pairs of telescoping tubes for preventing the tubes of said one pair from being separated said connecting means comprising a plurality of connecting members attached to said one inner tube and extending radially outwardly therefrom, each of the connecting members extending slidably through an opening in said one outer tuber.

4. The assembly of claim 3 including means on the outer end of each of the connecting members for preventing said outer end of the connecting member from being withdrawn radially inwardly through the opening in the outer tube.

5. The assembly of claim 3 in which each of said connecting members comprises an elongated flat strip, the plane of said strip extending generally through the axis of said telescoping tube.

6. The assembly of claim 5 in which the outer end of each of said connecting members terminates in an end portion which extends generally perpendicularly to the plane of the elongated flat strip.

* * * * *